US006401307B1

(12) United States Patent
Wild

(10) Patent No.: US 6,401,307 B1
(45) Date of Patent: Jun. 11, 2002

(54) WATCH STRAP

(75) Inventor: Daniel Wild, Le Sentier (CH)

(73) Assignee: Manufacture Jaeger-LeCoultre SA, Le Sentier (CH)

( * ) Notice: Subject to any disclaimer, the term of this patent is extended or adjusted under 35 U.S.C. 154(b) by 0 days.

(21) Appl. No.: 09/462,694

(22) PCT Filed: Jun. 19, 1998

(86) PCT No.: PCT/EP98/03751

§ 371 (c)(1),
(2), (4) Date: Apr. 17, 2000

(87) PCT Pub. No.: WO99/02061

PCT Pub. Date: Jan. 21, 1999

(30) Foreign Application Priority Data

Jul. 12, 1997 (DE) ..... 197 29 903

(51) Int. Cl.[7] ..... A44C 5/24
(52) U.S. Cl. ..... 24/71 J; 24/265 WS; 24/583
(58) Field of Search ..... 24/265 WS, 71 J, 24/68 CD, 583

(56) References Cited

U.S. PATENT DOCUMENTS

| | | | | |
|---|---|---|---|---|
| 2,532,840 A | | 12/1950 | Gaun | |
| 3,521,331 A | | 7/1970 | Gay | |
| 4,748,604 A | * | 5/1988 | Lambert | 24/71 J |
| 6,073,316 A | * | 6/2000 | Ferrario et al. | 24/71 J |

FOREIGN PATENT DOCUMENTS

| | | | | |
|---|---|---|---|---|
| CH | 0657763 | * | 9/1986 | 24/265 WS |
| CH | 663522 | | 12/1987 | |
| CH | 0668353 | * | 12/1988 | 24/265 WS |
| CH | 0669501 | * | 3/1989 | 24/265 WS |
| CH | 067556 | * | 8/1990 | 24/265 WS |
| DE | 4303173 | | 8/1994 | |
| EP | 0819391 | | 1/1998 | |
| GB | 661609 | | 11/1951 | |
| GB | 1482575 | | 8/1977 | |

* cited by examiner

*Primary Examiner*—Victor Sakran
(74) *Attorney, Agent, or Firm*—Martin A. Farber

(57) ABSTRACT

A invention relates to a watch strap, having a strap end link 1 which is connected to a further component such that it can be pivoted about an axis transverse to the longitudinal extent of the wrist strap and which can be adjusted relative to the further component in the direction of the longitudinal extent of the wrist strap. The strap end link 1 is articulated on a pivot element 3 such that it can be pivoted about an adjustment axis 2 which extends, approximately in the strap plane, transversely to the longitudinal extent of the wrist strap, the pivot element being connected to the further component such that it can be pivoted through approximately 180° about a pivot axis 4 which is parallel to the adjustment axis 2. In this case, the pivot element 3 can be arrested in its pivot end positions. The adjustment axis 2 and pivot axis 4 are arranged one behind the other in this case approximately along the longitudinal extent of the wrist strap.

11 Claims, 6 Drawing Sheets

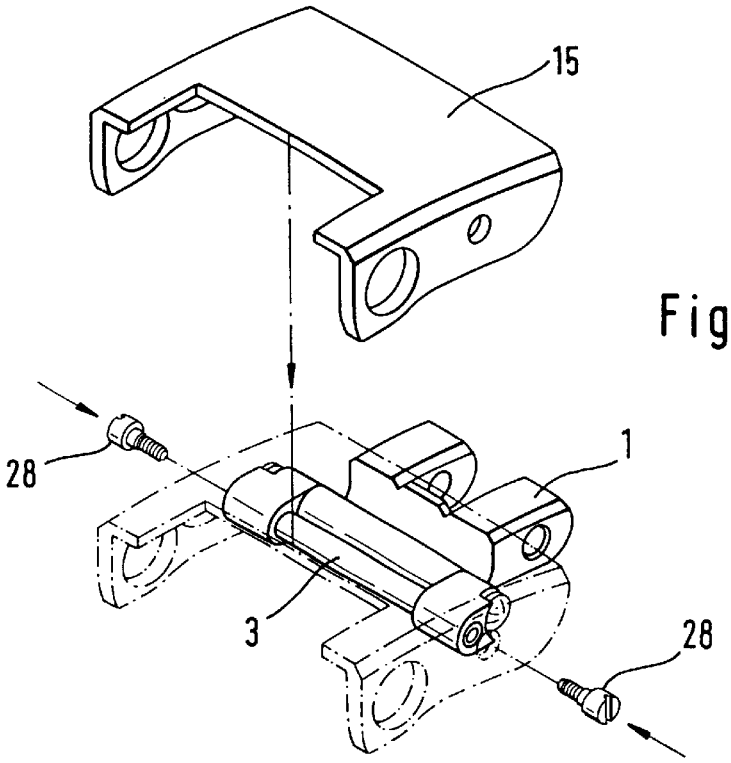
Fig. 3e
Fig. 4
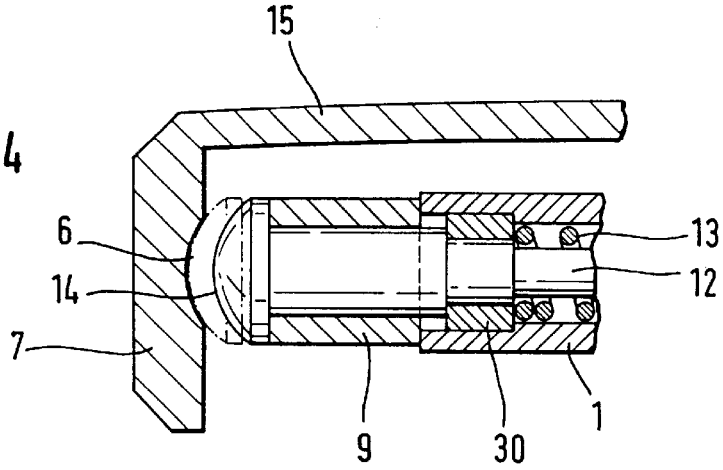
Fig. 5
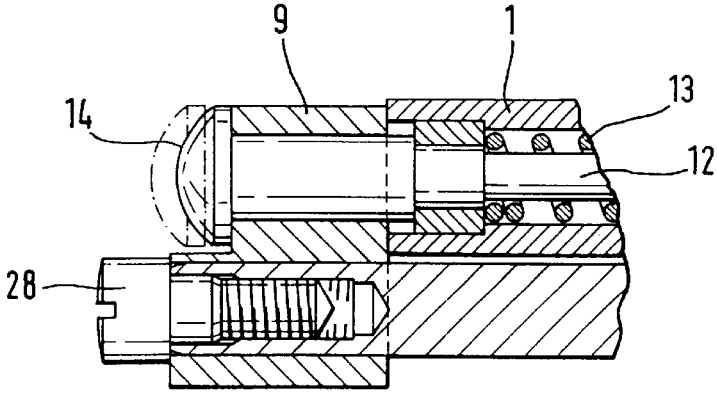

WATCH STRAP

FIELD AND BACKGROUND OF THE INVENTION

The invention relates to a wrist strap, in particular a watch strap, having a strap end link which is connected to a further component such that it can be pivoted about an axis transverse to the longitudinal extent of the wrist strap and which can be adjusted relative to the further component in the direction of the longitudinal extent of the wrist strap.

In the case of such a wrist strap, it is known for the strap end link to be connected to the further component via a telescoping element, namely a cover end link of a Z-like closure. In this case, in the closed state of the closure, the telescoping element is blocked such that there is no possibility of a change in length.

This design involves high outlay and requires that, before the closure is closed each time, it is ensured that the correct length of the telescoping element has been set.

SUMMARY OF THE INVENTION

The object of the invention is thus to provide a wrist strap of the type mentioned in the introduction which is of straightforward construction, is of a small overall size and avoids automatic adjustment of the length.

This object is achieved according to the invention in that the strap end link is articulated on a pivot element such that it can be pivoted about an adjustment axis which extends, approximately in the strap plane, transversely to the longitudinal extent of the wrist strap, said pivot element being connected to the further component such that it can be pivoted through approximately 180° about a pivot axis which is parallel to the adjustment axis, it being the case that the pivot element can be arrested in its pivot end positions, and the adjustment axis and pivot axis are arranged one behind the other approximately along the longitudinal extent of the wrist strap.

Straightforward pivoting of the pivot element through 180° achieves a change in length of twice the distance between the adjustment axis and pivot axis, which makes it possible for the pivot element, and thus the entire length-adjustment device, to be provided with a small overall size.

The further component may be either a closure part of a closure of the wrist strap or a strap connection element of a watch casing.

In order to ensure that the pivot element is not pivoted unintentionally, thus causing an undesired change in length, the pivot element can be arrested in its pivot end positions by a latching device.

For this purpose, in a straightforward formation, the pivot element has a latching element which is forced with resilient prestressing against the further component and, in the pivot end positions of the pivot element, can be latched into a latching recess of the further component.

The length-setting arrangement is both protected against damage and concealed when the wrist strap is worn if side parts of the further component grip around the axial end regions of the pivot element and the latching recess is formed in a side part, a latching element being supported resiliently on an axial end region of the pivot element and being forced against the side part, which has the latching recesses.

It goes without saying in this case that, for symmetrical loading, one latching element is arranged toward each side element.

A particularly straightforward construction with only a small number of components is achieved if the pivot element is approximately U-shaped and the strap end link projects into the opening of the "U", the pivot axis being arranged in the region of the base of the "U" and the adjustment axis being arranged in the region of the free legs of the "U".

If, in its region which projects into the opening of the "U", the strap end link has a through-passage bore which is formed coaxially with continuous grid-arrangement bores in the free legs of the "U", there being arranged in the grid-arrangement bores studs which project, by way of one end, into the through-passage bore of the strap end link and form the adjustment axis and are forced apart from one another by a prestressed compression spring, which is arranged in the through-passage bore, and are formed at their other end, which projects out of the grid-arrangement bore, as a latching head, then the studs have a double function and serve both as an adjustment axis, about which the strap end link can be pivoted, and as latching heads, in order to secure the pivot element in its pivot end positions.

In this case, use can be made of a single spring which has each of its two ends supported on a stud.

A combination of closure and length adjustment is achieved in a straightforward manner in that the closure part is a cover end link of a closure which can be collapsed in the manner of a Z and on which there is articulated a central link, on which there is articulated a base link, it being possible, in the collapsed state, for the cover end link to be connected to the base link by a latching connection.

For this purpose, the base link may have a catch support which, in the collapsed state of the Z-like closure, has the approximately U-shaped end of the cover end link, said end being directed away from the strap end link, gripping around its side regions, it being the case that projecting from a side region is a latching protuberance which can be moved into the catch support counter to a spring force and which can be latched into a latching depression on a leg of the U-shaped end of the cover end link.

The purposes of securing the closure and of providing symmetrical loading are also served here by the fact that a latching protuberance projects from each side region of the catch support, and each leg of the U-shaped end of the cover end link has a latching depression.

If the base link extends on both sides of the catch support, in the longitudinal direction of the strap, then the catch support may be part of a double-Z closure, of which each Z part may be provided with a length-adjustment device of the type described above.

BRIEF DESCRIPTION OF THE DRAWINGS

Exemplary embodiments of the invention are described in more detail hereinbelow and are illustrated in the figures of the drawings, in which FIG. 4 shows a vertical cross section of part of the length-adjustment device according to FIG. 2 in the region of the latching device, FIG. 5 shows a horizontal cross section of part of the length-adjustment device according to FIG. 2 in the region of the latching device.

DETAILED DESCRIPTION OF THE PREFERRED EMBODIMENTS

Figure 1:
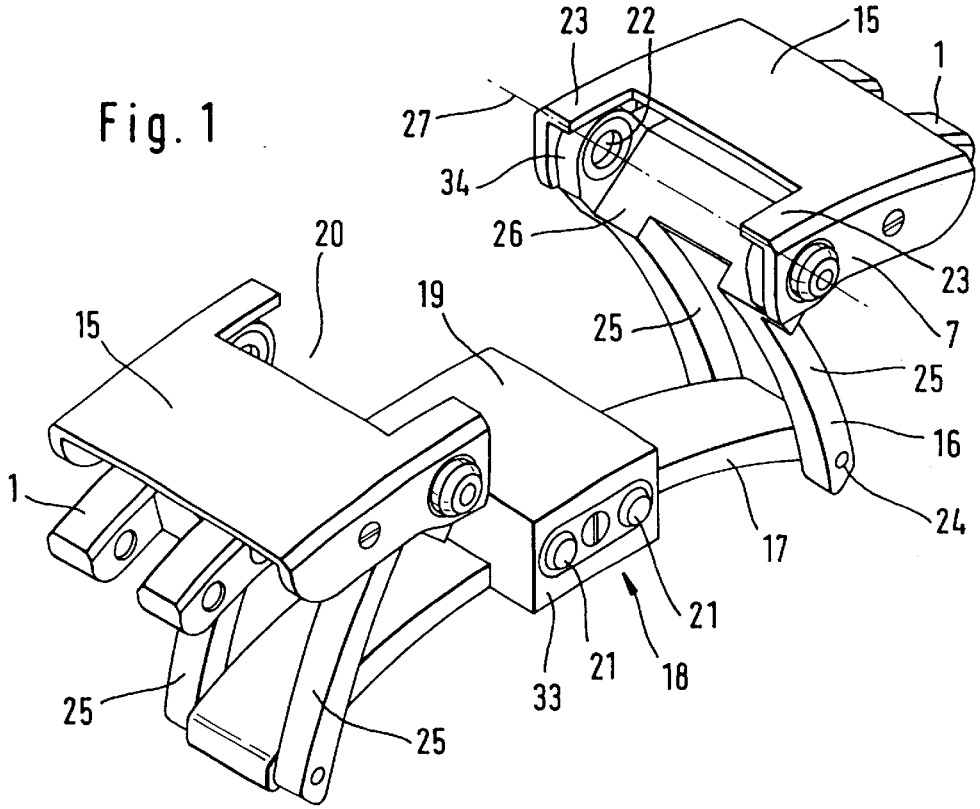
FIG. 1 shows a perspective view of a closure of a wrist strap.
Figure 2:
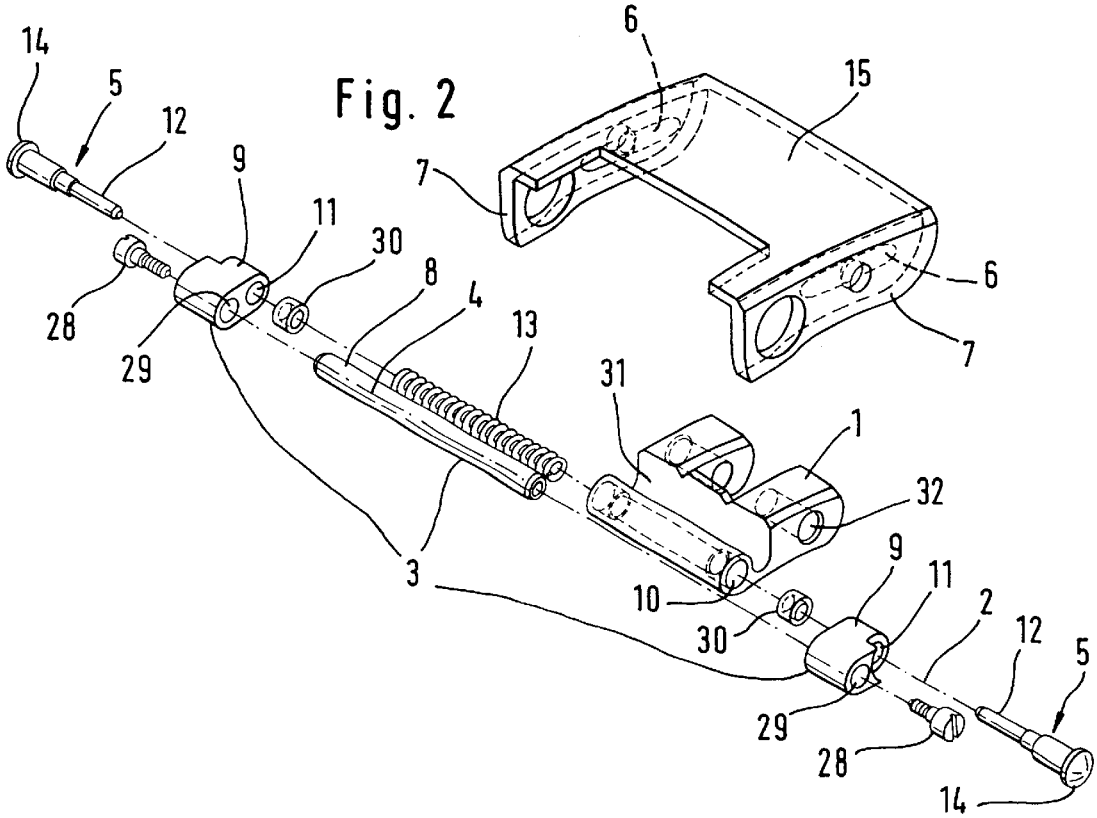
FIG. 2 shows an exploded illustration of a length-adjustment device of the closure according to FIG. 1, FIGS. 3*a*–3*e* show exploded illustrations of the assembly phases of the length-adjustment device according to FIG. 2.
Figure 3A:
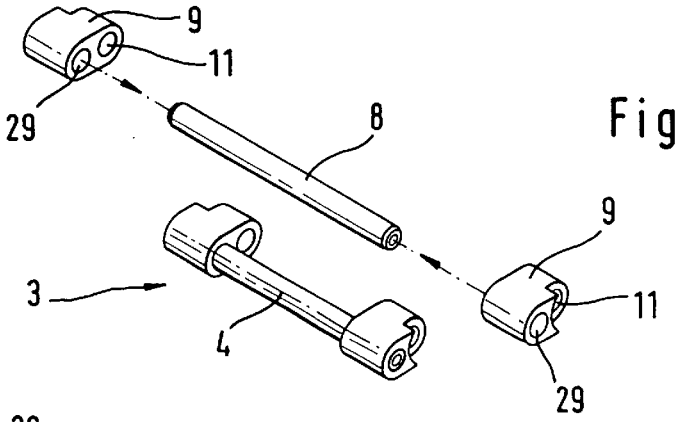
Figure 3B:
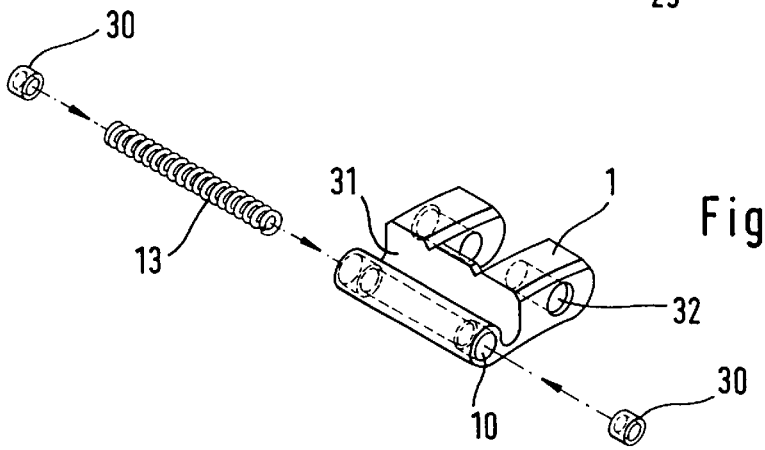
Figure 3C:
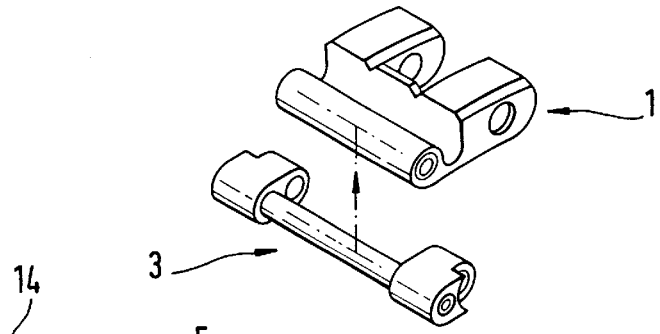
Figure 3D:
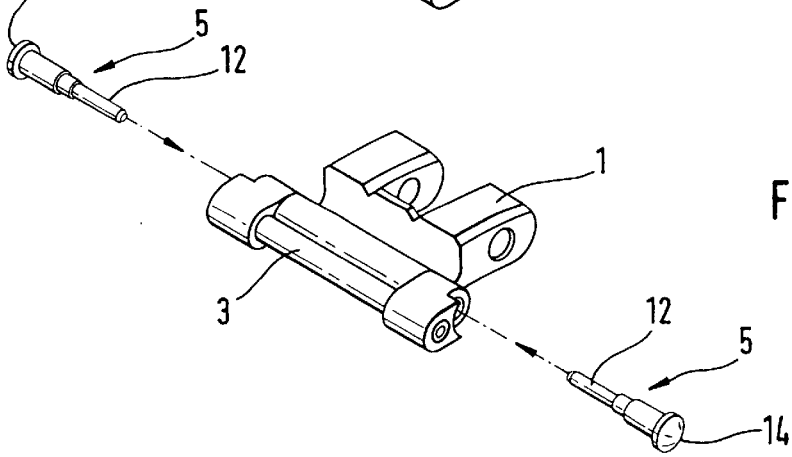

The closures illustrated in the figures are as double-Z closures and have a base link 17, in the central region of which a catch support 19 is arranged. At each of the two free ends of the base link 17, a central link 16 is articulated, by way of one free end, such that it can be pivoted about an axis 24 which extends, in the plane of the base link 17, transversely to the longitudinal direction of the strap. The central link 16 is of approximately U-shaped design and, in the collapsed state of the closure, encloses the base link 17 by way of its legs 25.

In the region of the base of the U-shaped central link 16, a cover end link 15 is articulated by way of its end such that it can be pivoted about an axis 27 which is parallel to the axis 24. The cover end link 15 is as a sheet-metal part with a U-shaped cross section and has the legs of the U-forming side parts 7. At one end, the cover end link 15 thus grips around the base 26 by way of its side parts 7 and, in this region, is also articulated on the central link 16.

Parallel to the axis 27, a pivot element 3 is articulated on the cover end link 15 such that it can be pivoted about a pivot axis 4, the pivot axis 4 likewise extending between the side parts 7.

The pivot element 3 is U-shaped and comprises a pin which forms the base 8 of the U, projecting away from which are free legs 9 of the U which are fixed on the base.

The pin extends coaxially with the pivot axis 4 and is inserted, by way of its ends, into corresponding through-passage bores 29 in the free legs 9.

Via pivot studs 28 arranged coaxially with the pin, the pivot element 3 is fastened pivotably on the cover end link 15. In the region of the free ends of the legs 9 of the pivot element 3, grid-arrangement bores 11 are formed parallel to the pivot axis 4, said bores passing through the free legs 9.

A strap end link 1 projects, by way of one end, into the opening of the U of the pivot element 3 and has a through-passage bore 10 formed coaxially with the grid-arrangement bores 11. Arranged in the through-passage bore 10, under axial prestressing, is a helical compression spring 13 which, via supporting rings 30 arranged in the through-passage bore 10, forces latching elements 5 laterally away from the strap end link 1.

The latching elements 5 comprise a stud 12 which, by way of one end, projects through the grid-arrangement bore 11 into the through-passage bore 10 and is subjected there, via the supporting ring 30, to the action of the compression spring 13. The studs 12, which project through the grid-arrangement bores 11 into the through-passage bore 10, form an adjustment axis 2 about which the strap end link 1 is articulated pivotably on the pivot element 3. At their other ends, which project out of the grid-arrangement bore 11, the studs 12 are provided with a respective latching head 14, these heads being supported on the inside of the side part 7 of the cover end link 15.

Figures 6A, 6B:
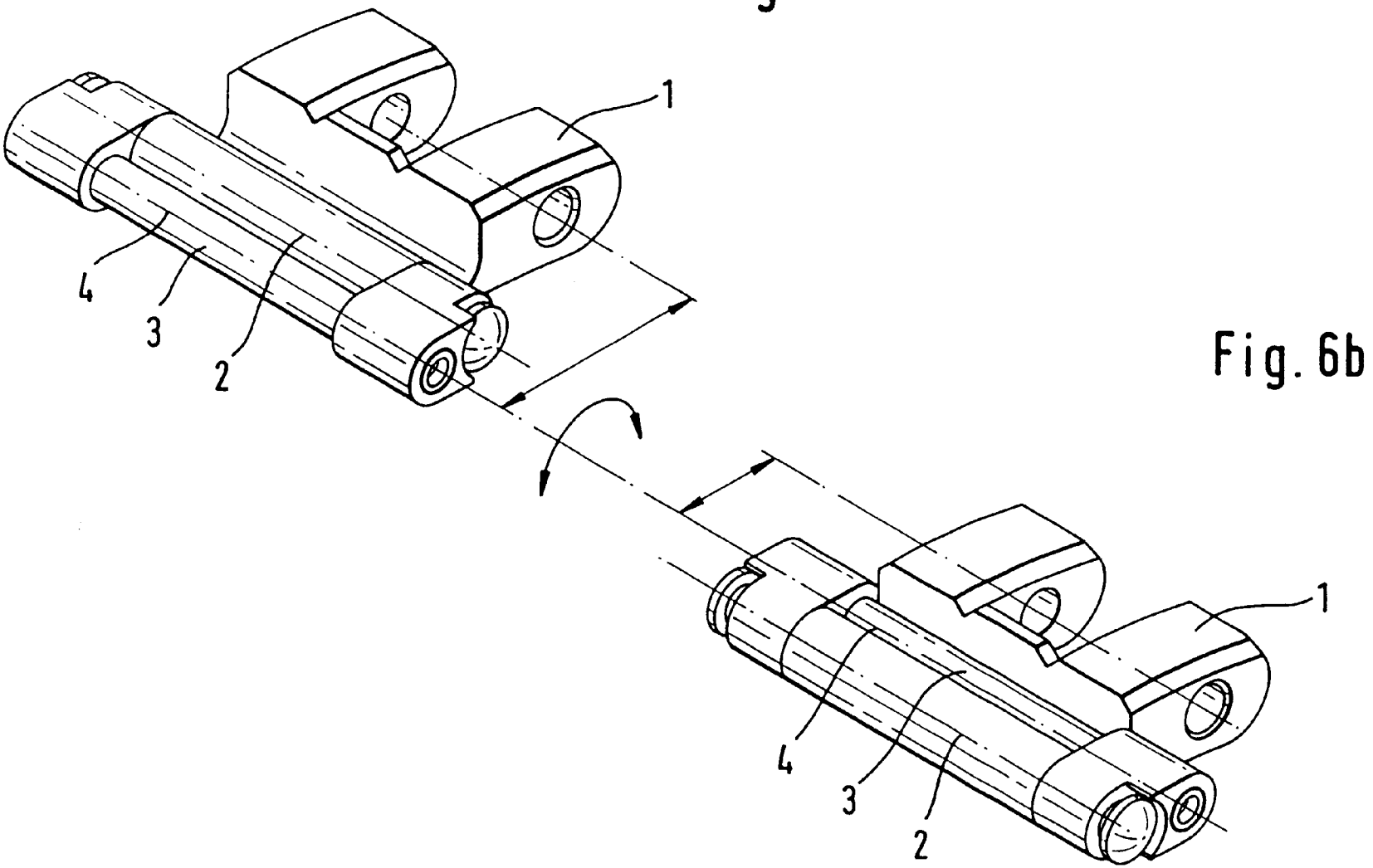
FIGS. 6*a*–6*b* show perspective views of the length-adjustment device according to FIG. 2 in the two pivot end positions.

As shown, in particular, by FIGS. 6*a* and 6*b*, the pivot element 3 can be pivoted through approximately 180° about the pivot axis 4 between a first pivot end position (FIG. 6*a*), in which the pivot element is directed toward the U-shaped end of the cover end link 15, and a second pivot end position (FIG. 6*b*), in which said pivot element is directed away from the U-shaped end 20 of the cover end link 15.

Formed on the insides of the side part 7 are grooves which extend along the longitudinal extent of the cover end link 15 and form latching recesses 6 in which the latching elements 5 latch, by way of their latching heads 14, in the pivot end positions and thus arrest the pivot element 3 in these pivot end positions. As can be seen in FIGS. 6*a* and 6*b*, the strap end link 1 in this case retains its alignment in the pivot end positions and is not pivoted along with the pivot element 3. In order that, in the position illustrated in FIG. 6*b*, the strap end link 1 can grip over the region of the base 8 of the pivot element 3, the strap end link 1 has a corresponding continuous groove 31 which is parallel to the pivot axis 4.

At its end which is opposite the location of articulation on the pivot element 3, the strap end link 1 is provided with a through-passage bore 32 parallel to the pivot axis 4, said bore being provided for the articulation of either further links of a link-type wrist strap or parts of some other wrist strap.

Depending on the pivoting of the two pivot elements 3 into the different pivot end positions, it is possible for the wrist strap to be adjusted in length in 4 steps.

As FIGS. 1, 7, 8 and 9 show, the cover end link 15 forms a joint component both of the length-setting device and of the closure.

In order to arrest the closure in the collapsed position, in which the recess of the U-shaped end 20 of the cover end link 15 grips around the catch support 19, latching protuberances 21 of a latching connection 18 are arranged in the lateral regions of the catch support 19 around which the U-shaped end 20 grips. These latching protuberances 21 project from the side regions 33 of the catch support 19 and can be moved into the catch support 19, a spring force being overcome in the process. In the region of the base 26 of the central link 16, approximately opposite the legs 25, the central link 16 has two projecting arms 34 which, in the collapsed state of the closure, grip around the catch support 19 in the region of the latching protuberances 21 thereof. Located opposite, and directed toward, the latching protuberances 21 in this position, latching depressions 22 are formed in the arms, and the latching protuberances 21 can be latched into the same.

The catch support 19 is formed as a housing with a housing interior 35 in which there are formed, one beside the other in the longitudinal direction of the strap, two receiving recesses 36 in which in each case one helical prestressed compression spring 37 is arranged. Inserted into the openings of the compression springs 37 are studs 38 of latching elements 39, which have an encircling, radially projecting border 40 by way of which they are supported at the ends of the compression springs 37. Opposite the pin 38, the latching elements 39 have the latching protuberances in 21, which project outward through openings 41 in the side wall of the catch support 19. The border 40 extends further in the radial direction than the openings 41, with the result that the border 40 also forms a stop for limiting the possible movement of the latching elements 39 in the outward direction.

Figure 7:
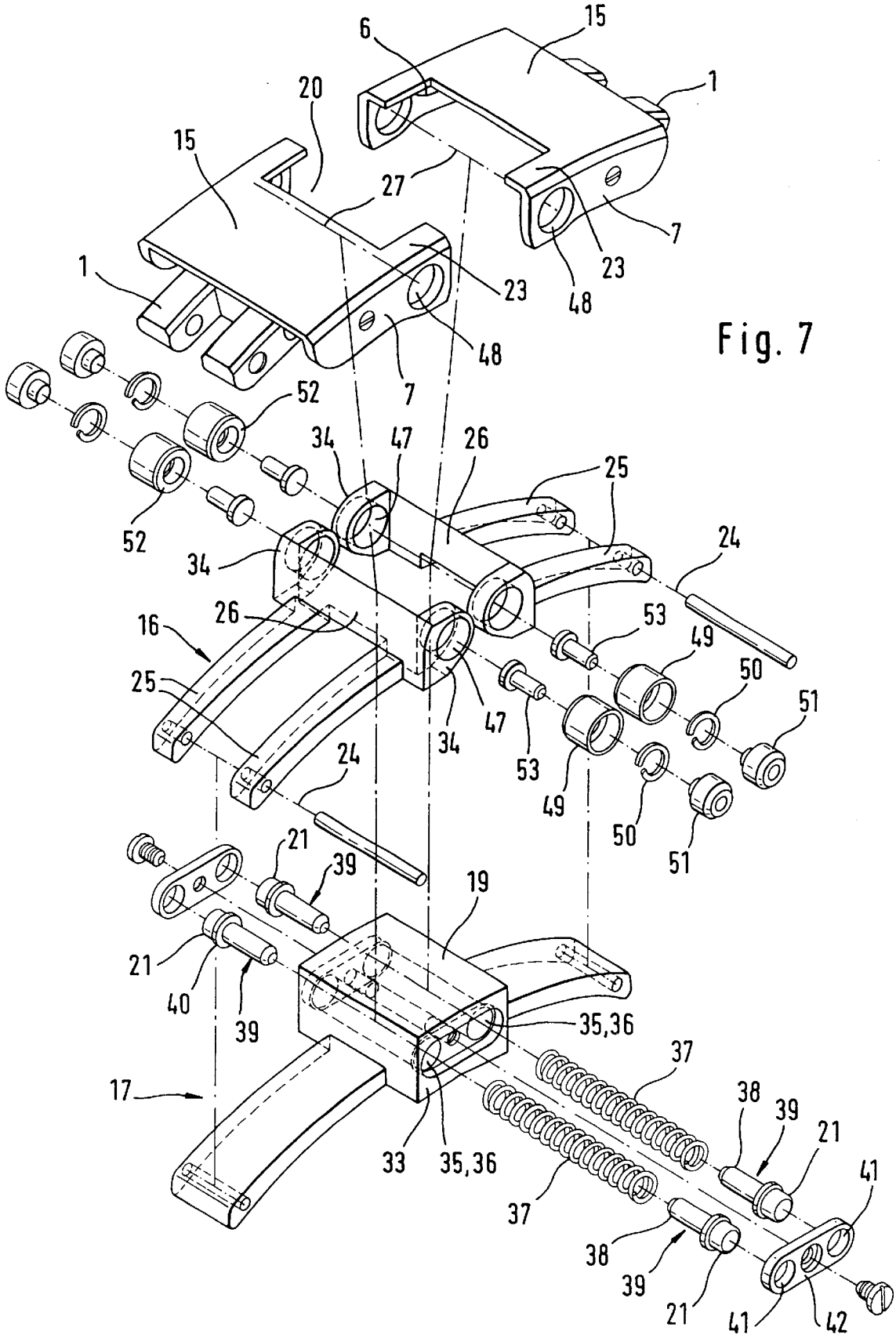
FIG. 7 shows an exploded illustration of the closure according to FIG. 1.

In FIG. 7, the openings 41 are formed in an insert part 42 which is screwed to the catch support 19, which is fixed on the base link 17.

Figure 9:
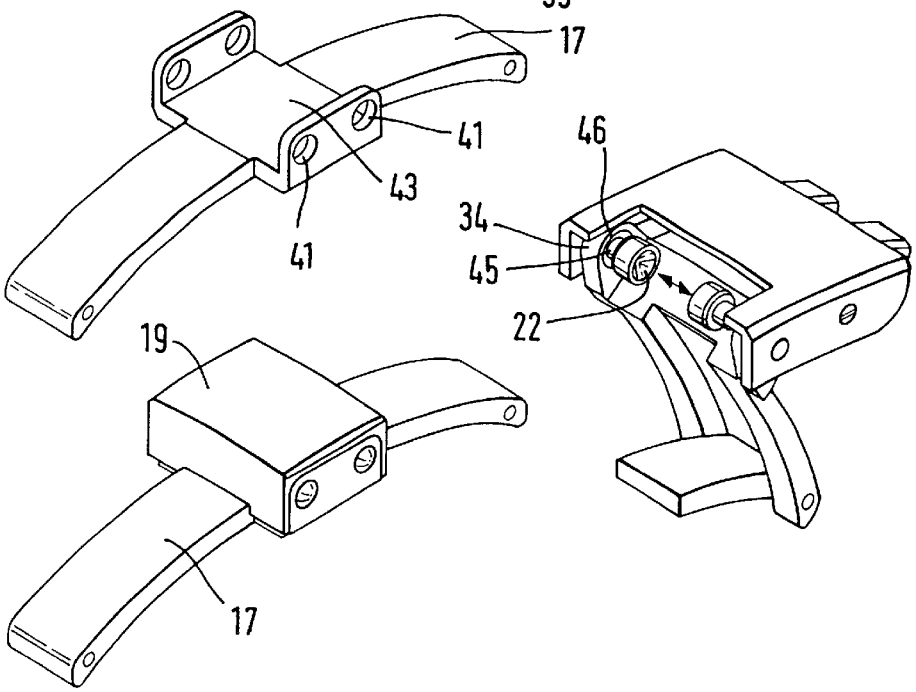
FIG. 9 shows an exploded illustration of the closure according to FIG. 8.

In FIG. 9, the catch support 19 comprises an approximately U-shaped bottom part 43 which is fixed to the base link 17 and on which it is possible to position a box-like housing part 44. The free legs of the bottom part 43 in this case form the side walls of the housing, which are directed transversely to the longitudinal direction of the strap and in which the openings 41 are formed.

Figure 8:
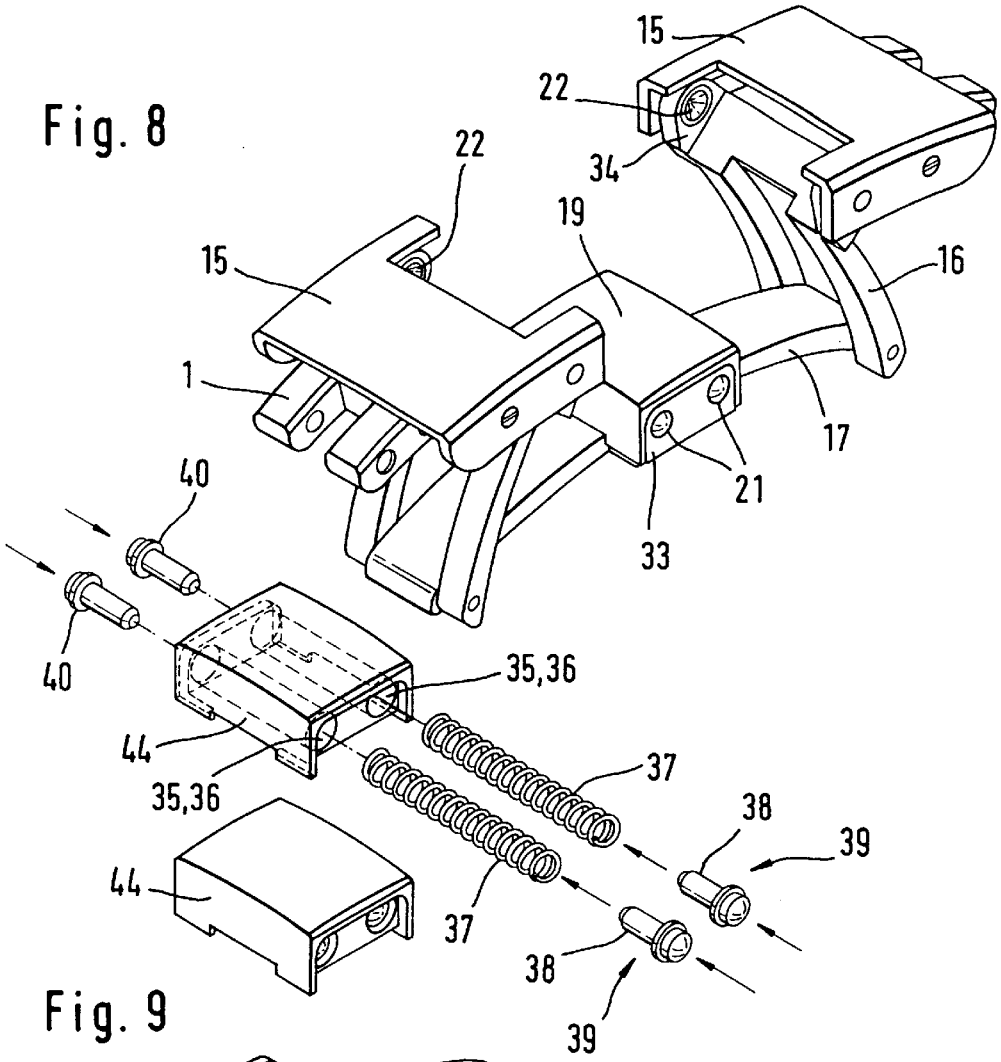
FIG. 8 shows a perspective view of a second exemplary embodiment of a closure of a wrist strap.

The legs 23 of the cover end link 15 grip around the arms 34 of the central link 16 and are articulated thereon. In FIGS. 8 and 9, the pivot axis of said articulation location is formed in that articulation studs 45 are arranged on the side parts 7 such that they project inward in the region of the legs 23, said studs projecting through corresponding bores 46 in the arms 34. The inwardly projecting end surface of the articulation studs 45 is provided with the latching depressions 22 and can be latched onto the latching elements 39.

In FIG. 7, bores 47 and 48 are formed, in alignment with one another, in that region of the legs 23 of the cover end link 15 which grips around the arms 34, the bores 48 having inserted into them bushings 49 which project into the bore 47 and serve as bearing journals for the central link 16.

Positioned in the bushing 49 is a spring ring 50 which is supported on a step 52 of the bushing 49.

From the outside, an outwardly projecting push button 51 butts against the spring ring 50. By activation of the push button 51, the latter can be moved into the bushing 49 and a push rod 53, which can be displaced in the bore 47, can be activated such that it projects out of the bore 47. If the push rod 53 is not activated by the push button 51, the push rod 53 is retracted into the bore 47 to the extent where the mouth of the bore 47 forms a latching depression 22.

In order to open the closed closure, the push buttons 51 are moved into the bushing 49, with the result that the push rods 53 move the latching protuberances 21 out of the mouths of the bores 47, said mouths forming the latching depressions 22. As a result, the latching connection 18 is released and the closure is open.

I claim:

1. A wrist strap, in particular a watch strap, having a strap end link which is connected to a further component such that it is pivotable about an axis transverse to a longitudinal extent of the wrist strap and which is adjustable relative to the further component in a direction of the longitudinal extent of the wrist strap, wherein the strap end link (1) is articulated on a pivot element (3) such that it is pivotable about an adjustment axis (2) which extends, approximately in a plane of the strap, transversely to the longitudinal extent of the wrist strap, said pivot element being connected to the further component such that it is pivotable through approximately 180° about a pivot axis (4) parallel to the adjustment axis (2), wherein the pivot element (3) is arrestable in its pivot end positions, and the adjustment axis (2) and the pivot axis (4) are arranged one behind the other approximately along the longitudinal extent of the wrist strap.

2. The arrangement as claimed in claim 1, wherein said further component is a closure part of a closure of the wrist strap.

3. The arrangement as claimed in claim 2, wherein the closure part is a cover end link (15) of a closure which is collapsable in the manner of a Z and on which there is articulated a central link (16), on which there is articulated a base link (17), wherein, in collapsed state, the cover end link (15) is connectable to the base link (17) by a latching connection (18).

4. The arrangement as claimed in claim 1, wherein said further component is a strap connection element of a watch casing.

5. The arrangement as claimed in claim 1, further comprising a latching device, and wherein the pivot element (3) is arrestable in its pivot end positions by said latching device.

6. The arrangement as claimed in claim 5, wherein the said pivotable element (3) has a latching element (5) which is forced with resilient prestressing against the further component and, in the pivot end positions of the pivot element (3), can be latched into a latching recess (6) of the further component.

7. A wrist strap, in particular a watch strap, having a strap end link which is connected to a further component such that it is pivotable about an axis transverse to a longitudinal extent of the wrist strap and which is adjustable relative to the further component in a direction of the longitudinal extent of the wrist strap, wherein the strap end link (1) is articulated on a pivot element (3) such that it is pivotable about an adjustment axis (2) which extends, approximately in a plane of the strap, transversely to the longitudinal extent of the wrist strap, said pivot element being connected to the further component such that it is pivotable through approximately 180° about a pivot axis (4) parallel to the adjustment axis (2), wherein the pivot element (3) is arrestable in its pivot end positions, and the adjustment axis (2) and the pivot axis (4) are arranged one behind the other approximately along the longitudinal extent of the wrist strap, further comprising a latching device, and wherein the pivot element (3) is arrestable in its pivot end positions by said latching device, and wherein said pivot element (3) has a latching element (5) which is forced with resilient prestressing against the further component and, in the pivot end positions of the pivot element (3), can be latched into a latching recess (6) of the further component and side parts (7) of said further component grip around axial end regions of the pivot element (3) and the latching recess (6) is formed in a side part (7), a latching element (5) being supported resiliently on an axial end region of the pivot element (3) and being forced against the side part (7), which has the latching recesses (6).

8. A wrist strap, in particular a watch strap, having a strap end link which is connected to a further component such that it is pivotable about an axis transverse to a longitudinal extent of the wrist strap and which is adjustable relative to the further component in a direction of the longitudinal extent of the wrist strap, wherein the strap end link (1) is articulated on a pivot element (3) such that it is pivotable about an adjustment axis (2) which extends, approximately in a plane of the strap, transversely to the longitudinal extent of the wrist strap, said pivot element being connected to the further component such that it is pivotable through approximately 180° about a pivot axis (4) parallel to the adjustment axis (2), wherein the pivot element (3) is arrestable in its pivot end positions, and the adjustment axis (2) and the pivot axis (4) are arranged one behind the other approximately along the longitudinal extent of the wrist strap, wherein the pivot element (3) is approximately U-shaped and the strap end link (1) projects into the opening of the "U", the pivot axis (4) being arranged in the region of a base (8) of the "U" and the adjustment axis (2) being arranged in the region of free legs (9) of the "U".

9. The arrangement as claimed in claim 8, wherein, in its region which projects into the opening of the "U", the strap end link (1) has a through-passage bore (10) which is formed coaxially with continuous grid-arrangement bores (11) in the free legs (9) of the "U", studs arranged in the grid-arrangement bores (11), said studs (12) project, by way of one end, into the through-passage bore (10) of the strap end link (1) and form the adjustment axis (2) and are forced apart from one another by a prestressed compression spring (13), which is arranged in the through-passage bore (10), and are formed at their other end, which projects out of the grid-arrangement bore (11), as a latching head (14).

10. A wrist strap, in particular a watch strap, having a strap end link which is connected to a further component such that it is pivotable about an axis transverse to a longitudinal extent of the wrist strap and which is adjustable relative to the further component in a direction of the longitudinal extent of the wrist strap, wherein the strap end link (1) is articulated on a pivot element (3) such that it is pivotable about an adjustment axis (2) which extends, approximately in a plane of the strap, transversely to the longitudinal extent of the wrist strap, said pivot element being connected to the further component such that it is pivotable through approximately 180° about a pivot axis (4) parallel to the adjustment axis (2), wherein the pivot element (3) is arrestable in its pivot end positions, and the adjustment axis (2) and the pivot axis (4) are arranged one behind the other approximately along the longitudinal extent of the wrist strap, wherein said further component is a closure part of a closure of the wrist strap, the closure part is a cover end link (15) of a closure which is collapsable in the manner of a Z and on which there is articulated a central link (16), on which there is articulated a base link (17), wherein, in the collapsed state, the cover end link (15) is connectable to the base link (17) by a latching connection (18) and the base link (17) has a catch support (19) which, in the collapsed state of the Z-like closure, has an approximately U-shaped end (20) of the cover end link (15), said end being directed away from the strap end link (1), gripping around its side regions (33), wherein projecting from a side region (33) is a latching protuberance (21) which is moveable into the catch support (19) counter to a spring force and which is latchable into a latching depression (22) on a leg (23) of the U-shaped end (20) of the cover end link (15).

11. The arrangement as claimed in claim 10, wherein a said latching protuberance (21) projects from each side region (33) of the catch support (19), and each leg (23) of the U-shaped end (20) of the cover end link (15) has a latching depression (22).

* * * * *